US006595324B2

(12) United States Patent
Brown

(10) Patent No.: US 6,595,324 B2
(45) Date of Patent: Jul. 22, 2003

(54) LADDER SAFETY HOOP SYSTEM

(75) Inventor: Richard T. Brown, Woodbury, MN (US)

(73) Assignee: Safety Brace, Inc., Inver Grove Heights, MN (US)

( * ) Notice: Subject to any disclaimer, the term of this patent is extended or adjusted under 35 U.S.C. 154(b) by 0 days.

(21) Appl. No.: 09/772,399

(22) Filed: Jan. 31, 2001

(65) Prior Publication Data

US 2002/0125070 A1 Sep. 12, 2002

Related U.S. Application Data

(63) Continuation-in-part of application No. 09/594,280, filed on Jun. 15, 2000, now abandoned.

(51) Int. Cl.[7] ..... E06C 7/14
(52) U.S. Cl. ..... 182/106; 182/107
(58) Field of Search ..... 182/106, 107, 182/121, 214

(56) References Cited

U.S. PATENT DOCUMENTS

| | | | | |
|---|---|---|---|---|
| 2,934,163 A | * | 4/1960 | Ladewski | |
| 4,643,274 A | * | 2/1987 | Tataseo | 182/106 |
| 5,507,362 A | * | 4/1996 | Krueger | 182/187 |
| 6,065,566 A | * | 5/2000 | Brown | |

FOREIGN PATENT DOCUMENTS

| | | | | |
|---|---|---|---|---|
| BE | 545713 | * | 3/1956 | 182/106 |
| FR | 806801 | * | 12/1936 | 182/121 |
| GB | 2093901 | * | 9/1902 | 182/121 |
| GB | 752280 | * | 7/1956 | 182/121 |

* cited by examiner

*Primary Examiner*—Alvin Chin-Shue
(74) *Attorney, Agent, or Firm*—Roger W. Jensen

(57) ABSTRACT

A safety enclosure for a human worker positioned on a ladder, comprising a bracket connectable to first and second preselected rungs of a ladder, having a longitudinally extending central portion preselected in length to span at least two adjacent rungs of the ladder. A continuous open hoop-like member having a preselected opening sized so as to freely encompass the midsection of a human worker is connected to the bracket means adjacent the first preselected rung. The hoop-like member has a pair of side portions extending normal to the bracket, and a back portion connecting the two side portions. Auxiliary hoop means connects the outboard ends of the side portions to the bracket and adjacent to the second preselected ladder rung. The bracket includes a first U-shaped hook-like portion sized to hook over and longitudinally engage the first rung. The bracket also includes, at the other end thereof, a U-shaped portion sized to snugly and normally encompass said second preselected rung. The safety enclosure further includes stabilizer means attached to the side portions and having members which may be moved normal to the bracket toward and adjacent to a building wall against which the ladder is resting.

18 Claims, 5 Drawing Sheets

LADDER SAFETY HOOP SYSTEM

This is a cip of Ser. No. 09/594,280, filed Jun. 15, 2000, abandoned.

BACKGROUND OF THE INVENTION

The field of this invention is to provide means for permitting a worker to safely work on a ladder above the ground, regard being given to the possibility of mishaps that can and do occur when such work is being performed. For example, the worker may be up on a ladder resting against a building, and the worker accidentally will come into contact with a source of electrical voltage sufficiently high so as to cause instantaneous involuntary action, the worker rearing out away from the ladder and building and falling to the ground below, usually incurring serious injury or immediate death.

While there are some prior art attempts or approaches for addressing the above-described problem, none of them are known to be fully satisfactory.

SUMMARY OF THE INVENTION

The present invention provides an economical, effective and practical solution to the above-stated problem. The present invention is a system for providing a safety enclosure for a human worker positioned up and standing on the rungs of a ladder, the ladder having first and second longitudinally extending legs spaced transversely apart in parallel relationship by a plurality of longitudinally spaced apart transversely extending rungs. The ladder is positioned with the top end portion thereof bearing against a building (usually the wall of the building) and with the bottom end portion thereof resting on the ground. The safety enclosure system broadly comprises a bracket means connectable to first and second preselected rungs of the ladder; in the preferred embodiment of the invention, the first and second preselected rungs are adjacent to one another. The safety enclosure means further includes a continuous open hoop-like member having a preselected opening sized so as to freely encompass the mid-section of a human worker, i.e., large enough effective diameter to enable the worker to do the intended work. The hoop-like member is connected to the bracket means adjacent to the first preselected rung, and the hoop-like member further comprises a pair of side portions extending substantially normal to the bracket, and further includes a back portion connecting the outboard ends of the side portions, i.e., the ends furthest from the ladder and bracket means.

The bracket means, in the preferred embodiment, has an elongated longitudinally extending portion preselected in length to span at least two adjacent rungs of the ladder; the bracket central portion has side portions extending normal thereto. The hoop-like member is connected to the respective side portions of the bracket means adjacent to the first preselected rung.

The bracket means further comprises at a first longitudinal end thereof a U-shaped hook-like elongated portion sized to hook over and longitudinally engage said first preselected rung, thus longitudinally supporting the bracket. The bracket means includes at a second longitudinal end thereof a U-shaped portion sized to snugly and normally encompass the second preselected rung. Furthers the aforesaid U-shaped portion sized to snugly encompass the second preselected rung includes means for locking or securing the bracket means to the second preselected rung, and thus locking the entire safety enclosure means to the ladder.

An auxiliary hoop means is provided in the preferred embodiment and is connected between the outboard ends of the sides of the main hoop and the bracket adjacent the second preselected rung.

The preferred embodiment further includes the above-described system in combination with a ladder supported at the bottom portion thereof with a pair of safety brace means, such as is shown in the Applicant's U.S. Pat. No. 6,065,566 entitled "LADDER SAFETY BRACE". Each of the safety brace means comprises an elongated brace connected at a first end thereof to one of the legs of the ladder, and having its other end resting on the ground support means at a greater distance away from the building than said bottom end portion of the ladder.

The preferred embodiment also includes stabilizing means for reducing or preventing rotation of the safety hoop, as mounted on the ladder as aforesaid, about the ladder's longitudinal axis as might be permitted by the torsion coefficient of the longitudinal legs of the ladder; the preferred rotation-reducing or prevention means comprising a pair of adjustable legs attached respectively to the sides of the hoop, the legs being adjustable along the normal axis to engage the wall of the building.

BRIEF DESCRIPTION OF THE DRAWINGS

FIG. 3 shows an enlarged view of the connection between the ladder safety hoop 10 and the rungs RA and RB of the ladder L.

DETAILED DESCRIPTION OF THE INVENTION

Figure 2:
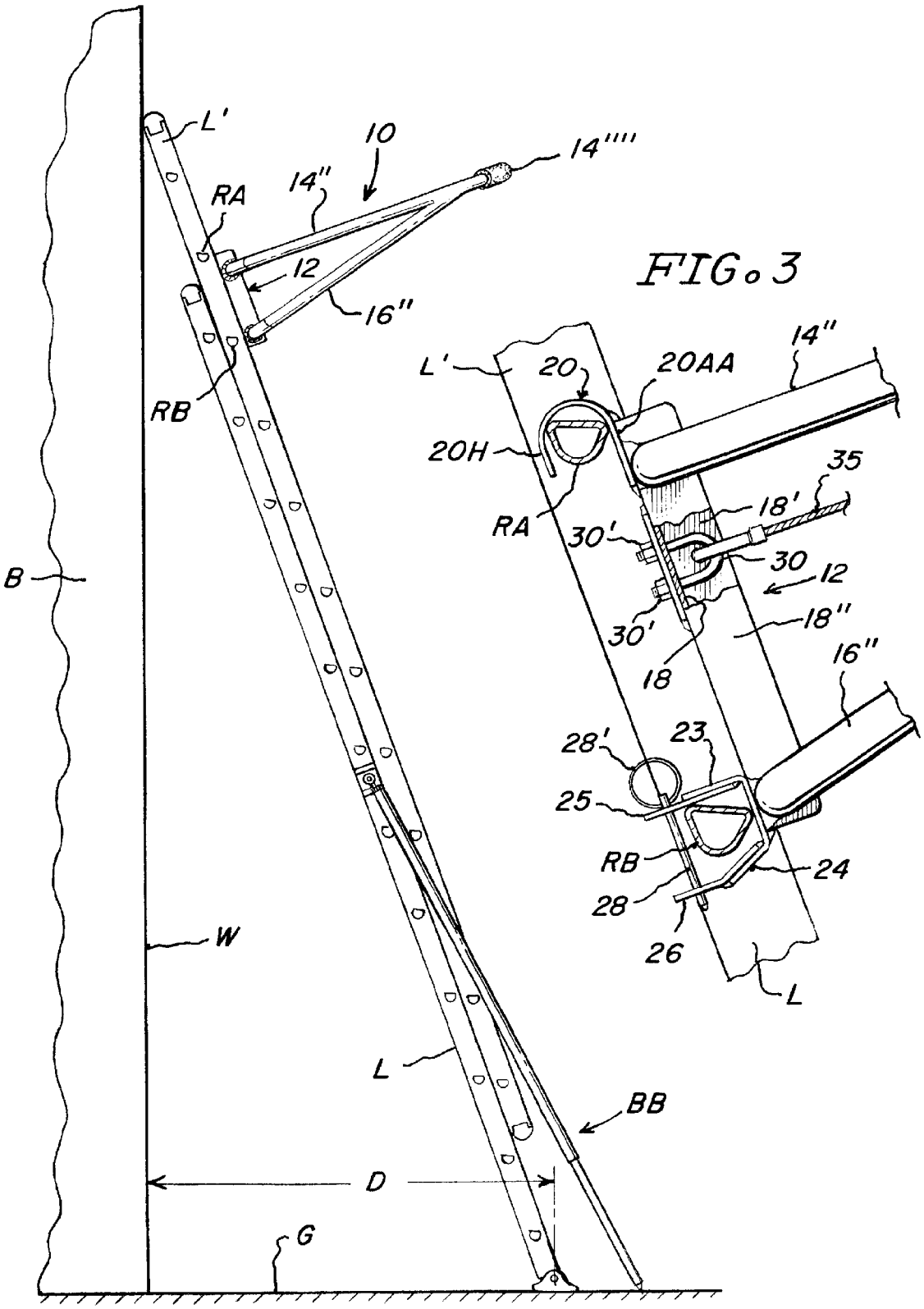
FIG. 2 is a side view of a ladder L resting on ground G and leaning against a wall W of a building B, the ladder safety hoop 10 of FIG. 1 is shown attached to an upper portion of the ladder, more specifically being connected to rungs RA and RB. A pair of safety braces BB (only one in FIG. 2) are connected between the legs of the ladder L and the ground.
Figure 4:
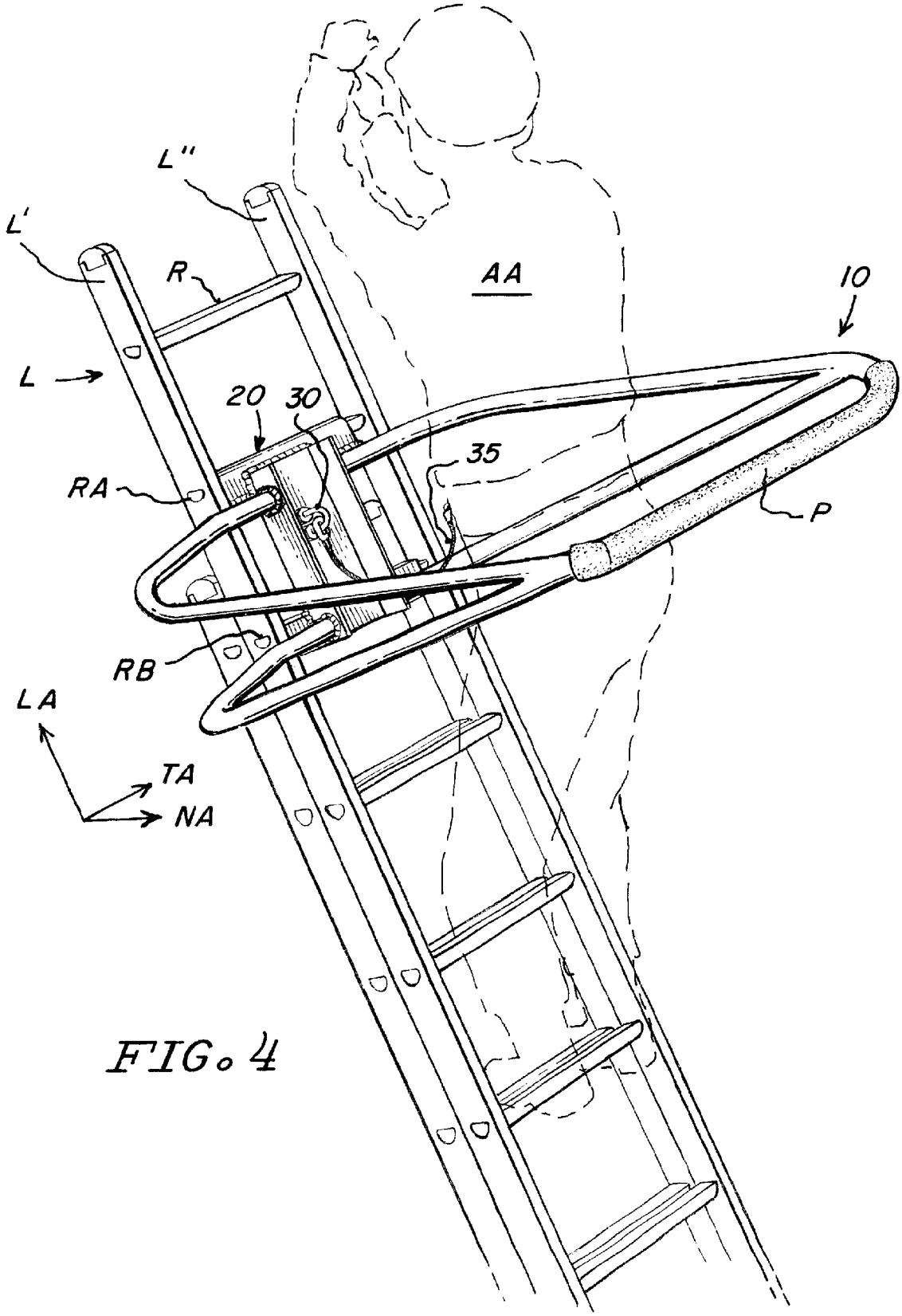
FIG. 4 shows the portion of the ladder L with the attached safety hoop 10; the mid-section of a human worker AA is freely encompassed by the hoop 10.

A ladder L of the extension type is shown in FIGS. 2, 3, and 4, and comprises first and second longitudinally extending legs L' and L" spaced transversely apart in parallel relationship by a plurality of longitudinally spaced apart transversely extending rungs R. FIG. 4 shows the three mutually perpendicular principal axes of the ladder L, namely the longitudinal axis LA, the transverse axis TA, and the normal axis NA. Ladder L is shown resting on the ground G with the bottom portion of the ladder being a distance D from the wall W of the building B. The upper end of the ladder is shown resting against wall W. The bottom portion of the ladder is supported with a pair of safety braces BB, preferably of the type shown in U.S. Pat. No. 6,065,566, entitled "LADDER SAFETY BRACE", which is incorporated herein for reference.

A bracket means 12 is connectable to first and second preselected rungs RA and RB of ladder L as is shown in FIG. 3. The bracket means has an elongated longitudinally extending central portion 18 preselected in length so as to span at least two adjacent rungs of the ladder; the central portion 18 has, along each of its longitudinal sides, side portions 18' and 18" extending normal thereto. Thus, the central portion 18 with sides 18' and 18" may be likened to a channel-member having a preselected longitudinal length, a preselected transverse width, and sides of preselected normal width.

Figure 1:
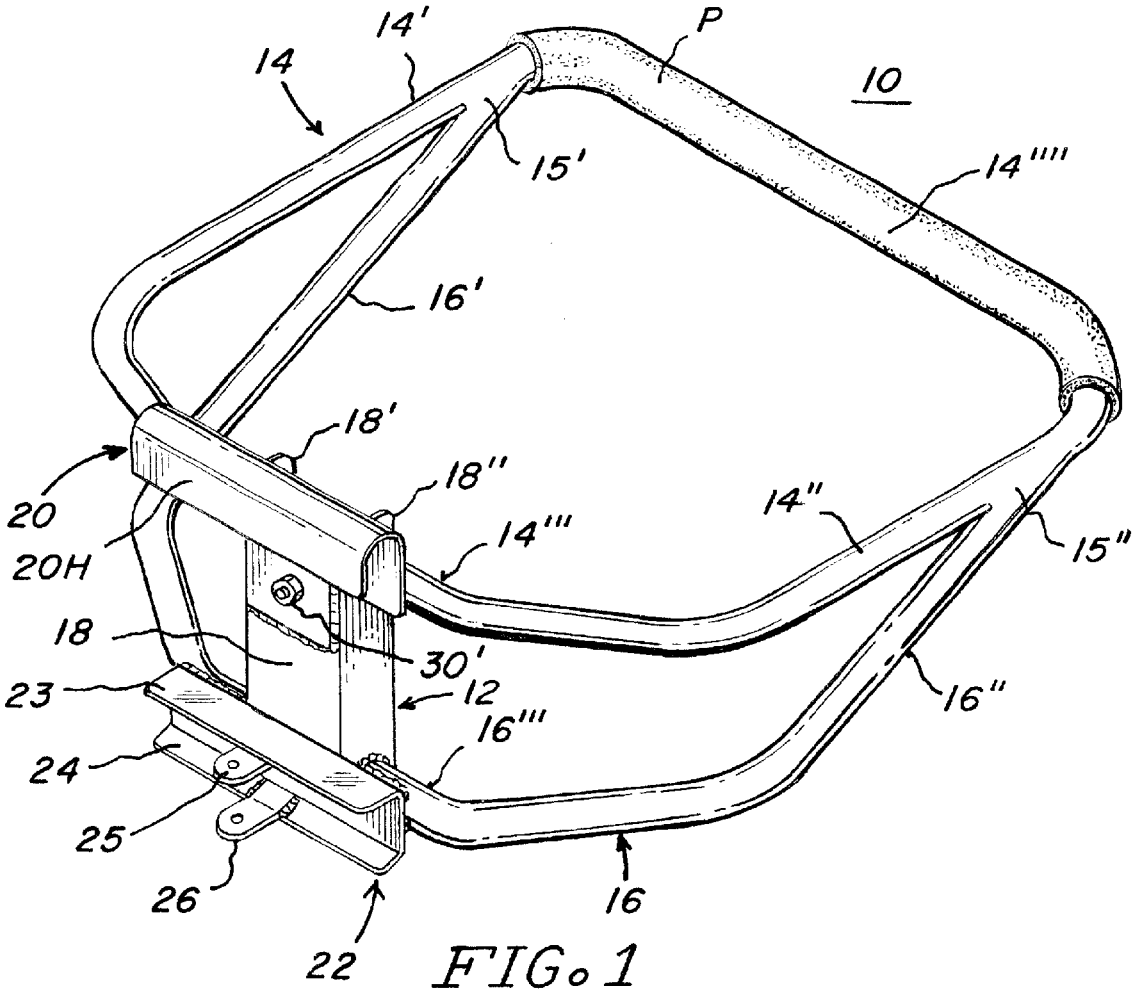
FIG. 1 is an isometric front-right side view of the preferred embodiment of the ladder safety hoop enclosure means 10 of this invention.

The top end of the bracket as shown in FIG. 3 is adapted to be hooked over the upper rung RA of the ladder. More specifically, a transversely extending U-shaped hook-like member 20 having a significant transverse length as is shown in FIG. 1 is connected at or near its midpoint, or center of one side 20AA thereof to the top of the bracket central portion 18. Hook member 20 has a curved portion 20H which is sized so as to hook over and longitudinally engage the first preselected rung RA; U-shaped hook 20 thus supports, in a longitudinal sense, the weight of the entire safety hoop 10.

The bracket further includes at its second or lower longitudinal end a U-shaped or channel portion 22 having normally extending sides 23 and 24. Channel 22 is connected at its center to central member 18. The sides 23 and 24 are sized and longitudinally spaced so as to snugly encompass the second preselected rung RB; the two spaced-apart sides 23 and 24 are clearly shown in FIGS. 1 and 3.

A locking means is provided for locking the bottom end of the bracket 12 to the ladder rung RB. The locking means includes tabs 25 and 26 extending respectively from sides 23 and 24, and having apertures 25' and 26' respectively, through which may be inserted a locking pin 28, with its associated pull ring 28' as is clearly shown in FIGS. 1 and 3.

The invention provides a continuous open hoop-like member 14 shown best in FIG. 1, having a preselected opening sized so as to freely encompass the midsection of a human worker AA shown in FIG. 4. The hoop 14 comprises a pair of spaced apart side portions 14' and 14" extending substantially normal to the central portion 18 of bracket 12 and having outboard ends 15' and 15", and a back portion 14'" connected to said outboard ends. The sides 14' and 14" are connected to the sides 18' and 18" of the bracket by continuations of the hoop, the continuation 14'" for connecting side 14" being shown in FIG. 1.

The preferred embodiment of the invention further includes an auxiliary bracket means 16 having side portions 16' and 16" joined to and integrally connected with the main hoop 14 near the outer ends 15' and 15" of the sides 14' and 14" respectively. The auxiliary bracket 16 is adapted to be connected to the lower end of the bracket 12; more specifically, the side portions 16' and 16" are connected respectively to the bottom portions of the sides 18' and 18" of the bracket 18, and adjacent to the second preselected rung RB. The connection between portion 16" and side 18" is identified in FIG. 1 by reference numeral 16'".

As described above, the U-shaped hook-like portion 20 has a substantial transverse extent so that when it is engaging the first preselected ladder rung RA, it will stabilize the hoop from rotation about the its longitudinal axis. Further, it will, as indicated, support the weight of the hoop. By the same token, the bracket 22 is depicted to be in the form of a transversely extending channel connected at the center thereof to the lower end of 18 by two channel sides 23 and 24 straddling the second preselected rung RB to provide stability.

Bracket means 12 further includes means to which a tethering line may be connected. More specifically, a U-bolt 30 shown connected to the central section 18 of the bracket and secured thereto by nuts 30' as shown in FIGS. 1 and 3, through which a tethering line 35 may be attached, the other end of which would be connected to a safety harness around the midsection of the worker AA as is depicted in FIG. 4.

The hoop 10, including the bracket means 12, is preferably made out of aluminum alloy having sufficient strength for the intended purpose. It will be understood, however, that other materials could be substituted.

A layer of soft padding material P may be provided around section 14'" of the hoop so as to add a comfort factor for the worker.

The auxiliary hoop members 16' and 16" provide (i) structural strength and rigidity to the enclosure means 10, and (ii) additional transverse support for the worker AA.

The two U-shaped members 20 and 22 facilitate a very stable connection of the bracket 12 to the ladder. Member 20 not only longitudinally supports the weight of the bracket (and thus the entire enclosure means 10) but also prevents any rotation of enclosure 10 relative to the ladder about its longitudinal axis. Simultaneously, member 22 not only holds bracket 12 and thus enclosure 10 with respect to the ladder but also prevents any rotation of enclosure 10 about its normal axis.

If the worker AA, for any reason, was thrown backwardly away from the ladder, the safety hoop back portion 14'" would arrest such movement. If the worker lost his or her footing, the tether 35 would prevent a fall to the ground. The safety braces BB, installed as shown in FIG. 2, prevent the top of the ladder L from moving away from the building. Thus braces BB provide a complementary safety function; if the worker AA's body strikes portion 14'" with sufficient momentum so as to tend to have the top of the ladder move away from the building (a clockwise rotation about the transverse axis TA as shown in FIG. 4), such rotation would be prevented by braces BB configured as shown in FIG. 2.

Figure 5:
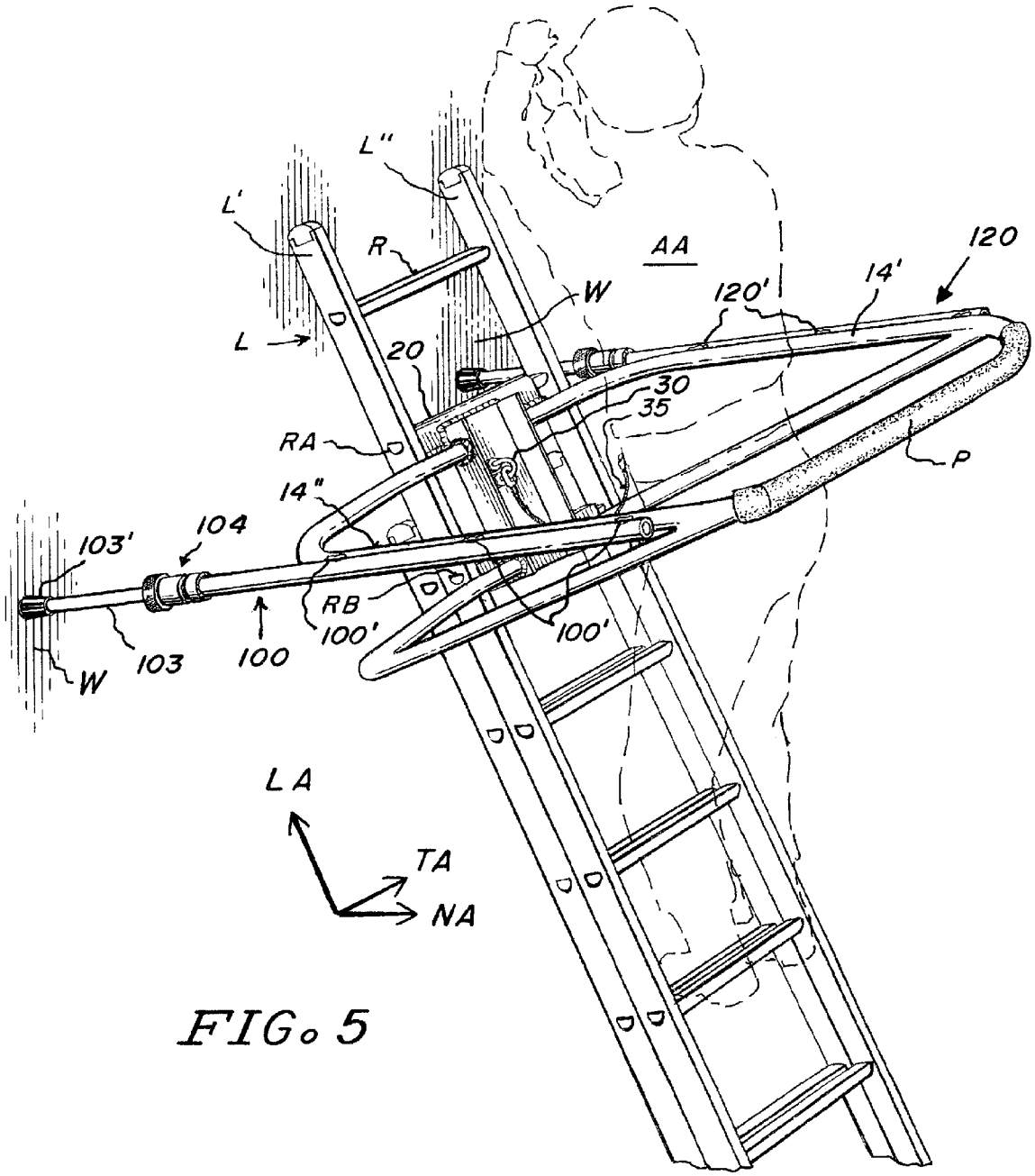
FIG. 5 shows an isometric front-right side view of a modification of the safety hoop of FIGS. 1–4, with the addition of means for reducing or preventing rotation of the safety hoop/ladder about the ladder's longitudinal axis LA.
Figure 6:
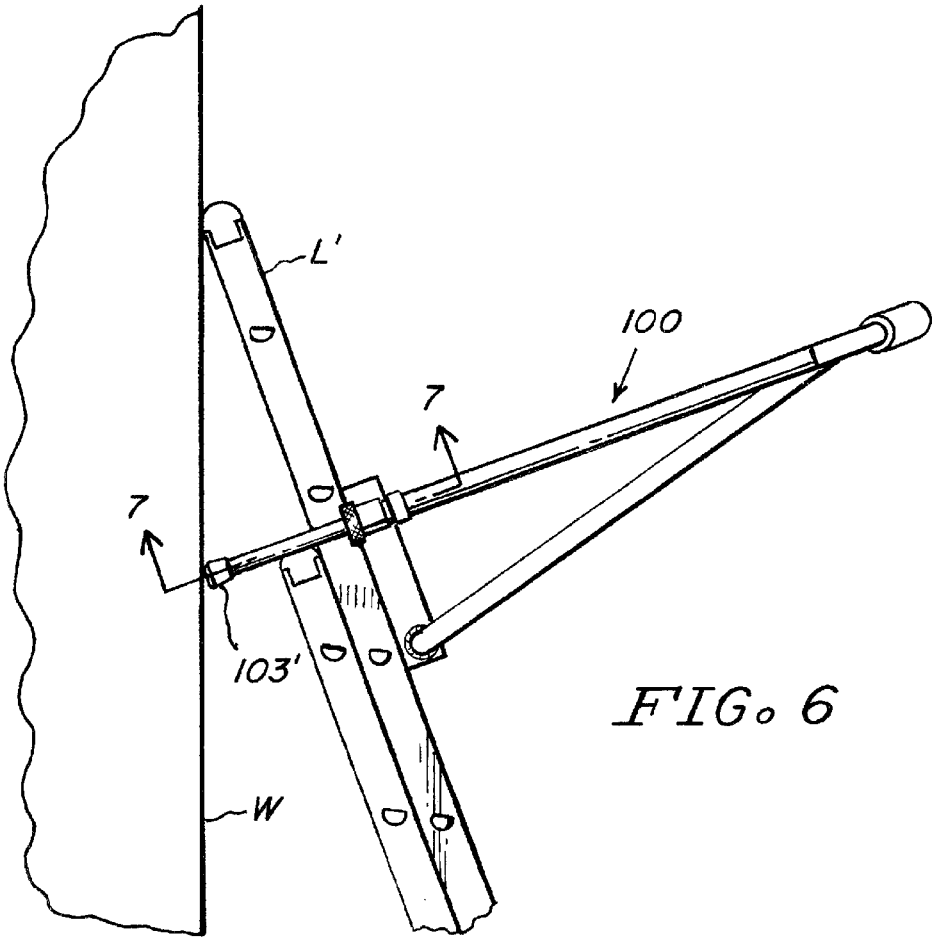
FIG. 6 shows a side view of the modification of FIG. 5.
Figure 7:
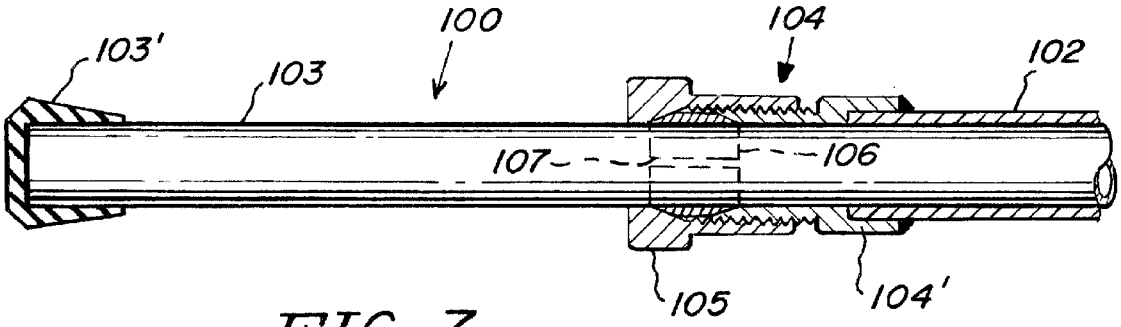
FIG. 7 shows a detail of one of the adjustable legs 100 as view along section lines 7—7 of FIG. 6.

FIGS. 5–7 show a modified apparatus which will prevent undesired rotation of the safety hoop (mounted on the ladder as aforesaid) about the longitudinal axis LA. It will be understood that ladders have greater or lesser resistance to such rotation depending on the design specifications thereof. The modified apparatus comprises a pair of identical, transversely spaced apart, normally oriented adjustable leg assemblies 100 and 120 connected by suitable means such as welding 100' and 120' to portions 14" and 14', respectively, of hoop 10. Thus, leg assembly 100 comprises a tubular member 102 (see FIG. 7) attached to hoop portion 14" and sized to receive (in telescope-like manner) an extension rod or tube 103 having a length similar to that of member 102. The rod 103 may be adjusted along the normal axis NA to any desired position, e.g., wall W, and locked thereat by a hand-rotatable clamping means 104 of the well-known type shown in FIG. 7. An externally threaded sleeve 104' attached to the outer end of member 102, a union 105 with internal threads, and a collet 106 with gap 107 positioned between sleeve 104' and union 105. A cap or cup 103' may be provided at the outer end of 103 to prevent any marring of the wall surface.

Thus, in typical operation, the worker AA would sequentially 1) position ladder L against wall W, 2) attached bracket 12 to preselected ladder rungs as aforesaid to attach enclosure 10 to the ladder, and 3) position and lock rod 103 (and its corresponding member in stabilizer 120) to abut 103' against wall W.

While the preferred embodiment of the invention has been illustrated, it will be understood that variations may be made by those skilled in the art without departing from the inventive concept. Accordingly, the invention is to be limited only by the scope of the following claims.

I claim:

1. A system for providing a safety enclosure for a human worker positioned on a ladder having first and second longitudinally extending legs spaced transversely apart in parallel relationship by a plurality of longitudinally spaced apart transversely extending rungs, said ladder being positioned with the top end portion thereof bearing against a building and with the bottom end portion thereof resting on ground support means, said safely enclosure means comprising:

a. a bracket means connectable to first and second preselected rungs of said ladder;

b. a continuous open hoop-like member having a preselected opening sized so as to freely encompass the mid-section of a human worker, said member being connected to said bracket means and said member having a pair of side portions extending substantially normal to said bracket means, said side portions having outboard ends, and a back portion connecting said outboard ends of said side portions; and c. at least one adjustable stabilizer means aligned with and attached to one of said side portions comprising (i) a telescopic elongated member having an end and positioned to be moved in a direction normal to said bracket means so that said end thereof is in adjacent abutting relationship with said building, and (ii) locking means for locking said telescopic elongated member in a refracted and extended positions, said bracket means and said continuous open hoop-like member bring an integral unit.

2. The system of claim 1 wherein said bracket means includes at a first end thereof a U-shaped hook-like portion sized to hook over and snugly engage said first preselected rung.

3. The system of claim 1 wherein said bracket means includes at an end thereof a U-shaped portion sized to snugly encompass said second preselected rung.

4. The system of claim 3 wherein said U-shaped portion sized to snugly encompass said second preselected rung includes means for locking said bracket means to said second preselected rung.

5. The system of claim 2 wherein said bracket means includes at a second end thereof a U-shaped portion sized to snugly encompass said second preselected rung.

6. The system of claim 5 wherein said U-shaped portion sized to snugly encompass said second preselected rung includes means for locking said bracket means to said second preselected rung.

7. The system of claim 1 wherein said hoop-like member is connected to a first end of said bracket means, and further includes auxiliary hoop means connecting the outboard ends of said side portions of said hoop-like member to a second end of said bracket means.

8. The system of claim 1 wherein said bracket means includes means to which a tethering line may be connected.

9. A system for providing a safety enclosure for a human worker positioned on a ladder having first and second longitudinally extending legs spaced transversely apart in parallel relationship by a plurality of longitudinally spaced apart transversely extending rungs, said ladder being positioned with the top end portion thereof bearing against a building and with the bottom end portion thereof resting on ground support means, said safely enclosure means comprising:

a. a bracket means connectable to first and second preselected rungs of said ladder, said bracket means having an elongated longitudinally extending central portion preselected in length to span at least two adjacent rungs of said ladder and side portions extending normal thereto;

b. a continuous open hoop-like member having a preselected opening sized so as to freely encompass the mid-section of a human worker, said member being connected to one longitudinal end of said bracket means aligned with and said member having a pair of side portions extending substantially normal to said central portion of said bracket and a back portion connecting the outboard ends of said side portions; and c. a pair of adjustable stabilizer means attached respectively to said side portions of said hoop-like member, each comprising (i) a telescopic elongated member having an end and positioned to be moved normal to said bracket means so that said end thereof may be positioned in adjacent and abutting relationship with said building, and (ii) locking means for locking said telescopic elongated member in a refracted and extended positions, said bracket means and said continuous open hoop-like member being an integral unit.

10. The system of claim 9 wherein said bracket means includes at a first longitudinal end thereof a U-shaped hook-like portion sized to hook over and longitudinally engage said first preselected rung.

11. The system of claim 9 wherein said bracket means includes at a second longitudinal end thereof a U-shaped portion sized to snugly and normally encompass said second preselected rung.

12. The system of claim 11 wherein said U-shaped portion sized to snugly encompass said second preselected rung includes means for locking said bracket means to said second preselected rung.

13. The system of claim 10 wherein said bracket means includes at a second longitudinal end thereof a U-shaped portion sized to snugly and normally encompass said second preselected rung.

14. The system of claim 13 wherein said U-shaped portion sized to snugly encompass said second preselected rung includes means for locking said bracket means to said second preselected rung.

15. The system of claim 9 and auxiliary bracket means connecting the outboard ends of said side portions of said member to another longitudinal end of said bracket means.

16. The system of claim 15 wherein said bracket means includes means to which a tethering line may be connected.

17. The system of claim 15 in combination with a ladder supported at the bottom portion thereof with a pair of safety brace means, each of said safety brace means comprising an elongated brace connected at a first end thereof to one of said legs of said ladder and having its other end restable on said ground support means at a greater distance from said building than said bottom end portion of said ladder.

18. The system of claim 1 in combination with a ladder supported at the bottom portion thereof with a pair of safety brace means, each of said safety brace means comprising an elongated brace connected at a first end thereof to one of said legs of said ladder and having its other end restable on said ground support means at a greater distance from said building than said bottom end portion of said ladder.

* * * * *